US005584311A

United States Patent [19]

Schaefer

[11] Patent Number: 5,584,311

[45] Date of Patent: Dec. 17, 1996

[54] SELF-SUPPORTED TENT FRAME COUPLER

[76] Inventor: Gary Schaefer, P.O. Box 390, Belgrade, Mont. 59714

[21] Appl. No.: 495,214

[22] Filed: Sep. 25, 1995

[51] Int. Cl.[6] ..... F16C 11/00; E04H 15/32

[52] U.S. Cl. ..... 135/128; 403/103; 403/84; 403/110; 135/140; 135/121; 135/147; 135/157; 135/120.3; 135/133

[58] Field of Search ..... 403/103, 106, 403/87, 84, 110; 135/121, 122, 140, 147, 151, 157, 114, 120.3, 120.1, 128, 132, 133, 135

[56] References Cited

U.S. PATENT DOCUMENTS

| | | | |
|---|---|---|---|
| 1,204,329 | 11/1916 | Wilkens | 403/110 |
| 2,554,292 | 5/1951 | Brown | 403/103 X |
| 2,647,676 | 8/1953 | Napiecinski | 403/103 X |
| 3,167,081 | 1/1965 | Higgins | 135/151 X |
| 3,870,061 | 3/1975 | Lowery | 135/140 X |
| 4,439,053 | 3/1984 | Pelz | 403/84 X |
| 5,069,238 | 12/1991 | Marks | 135/109 |
| 5,195,551 | 3/1993 | Ju | 135/135 X |
| 5,255,698 | 10/1993 | Riley | 135/103 |
| 5,263,507 | 11/1993 | Chuang | 135/140 |
| 5,265,969 | 11/1993 | Chuang | 403/103 X |

FOREIGN PATENT DOCUMENTS

| | | | |
|---|---|---|---|
| 0346997 | 7/1960 | Switzerland | 135/122 |
| 2047323 | 11/1980 | United Kingdom | 403/103 |

*Primary Examiner*—Wynn E. Wood
*Attorney, Agent, or Firm*—D. L. Tschida

[57] ABSTRACT

An internal, self-supporting, tent suppot framework. The collapsible framework includes a number of side and ridge support poles which mount to radially adjustable pole couplers. The couplers retain the support poles at preferred angular orientations in multiple wall planes as a support skeleton for an overlying fabric cover. Each coupler includes a pair of cast sleeves wherein a body piece includes a longitudinal bore, a projecting wing arm and a pair of hinge arms having transverse bores. A horizontal pole couples the hinge arms together in one plane, as a pair of other poles are supported to the longitudinal bores in a second plane at a splay angle established by the wing arms. The wing arms overlap and are retained with a fastener fitted between the arms.

18 Claims, 8 Drawing Sheets

SELF-SUPPORTED TENT FRAME COUPLER

BACKGROUND OF THE INVENTION

The present invention relates to tent support systems and, in particular, to an internal, self-supporting assembly which utilizes a number of radially adjustable pole couplers. A pair of cast sleeve bodies couple together with a supported pole at aligned bores of a number of hinge arms. A pair of other poles extend from the sleeve bodies at a splay angle established by a pair of wing arms to form a support skeleton for an overlying canvas cover.

With the increasing popularity of outdoor activities, a resurgence of interest has occurred in the outdoor recreation and camping industries. A variety of designs for stable, collapsible frame tents have evolved to meet this demand. Such tents are designed to meet the needs of a variety of users from backpackers, to weekend campers, who camp from their vehicle, to outfitted camps that are established in remote sites from horseback or four-wheeled vehicles.

Many tent support frames utilize a number of small diameter (i.e. less than ½ inch) poles constructed of fiberglass, aluminum or high strength materials. The poles frequently contain elastic shock cords and typically mount through fabric loops or to sleeves or clips secured to the tent fabric. With the assembly and attachment of the poles to the tent fabric, the tent is erected and held taught. Some small tents provide self-contained support poles, which are permanently retained to the tent fabric.

So-called "sheep herder" tents have also shared in the resurgence of interest in camping. Historically, such tents were principally used by nomadic sheep herders. Now tents offering comparable functionality are being used by families and groups of hunters and fishermen for multi-day, base camps. The tents provide relatively large floor spaces and contain woodstoves and various camp support furnishings in a weather protected setting.

Traditionally, the support framework for such tents was mounted external to the fabric. More recently, internal frame support systems have been developed to more efficiently perform the same function with re-usable, lightweight poles.

One such support system is described at U.S. Pat. No. 5,255,698. Rigid sleeve couplers are provided which retain pole sections that can be rotated in the sleeves. Although the system adequately supports a tent and is susceptible to volume production with modular couplers, the couplers do not readily accommodate cabin style tents.

Another support system is disclosed at U.S. Pat. No. 5,069,238. This assembly provides hinged couplers which contain end support poles at a defined orientation to each other. Guy ropes, in turn, support the end frames and an overlying fabric cover. The couplers support the poles only in a single plane and are not able to contain longitudinal support poles, which are desired in a self-supporting framework.

Other couplers used in self-supporting frames are known which provide sleeves that are welded at defined orientations. A number of different types of couplers, dependent upon the location of each joint, are required to erect such frames. Interconnecting poles mount in the sleeves at specific structural locations and tarps are fitted over the skeleton.

The coupler of the present invention was developed to overcome the disadvantages of the foregoing systems. The present coupler provides a standardized cast fitting, which is sized to receive a number of tubular poles that radiate in multiple planes. The poles can either be cut-to-length or can telescope. Restrained extension arms radiate from tubular sockets or body pieces and determine a splay angle at the coupler for a pair of support poles disposed in one plane. One or more other support poles extend in a second plane and serve as a hinge pin for the coupler at aligned bores of included hinge arms.

SUMMARY OF THE INVENTION

It is a primary object of the invention to provide a modularly configured tent support framework.

It is a further object of the invention to provide a framework including couplers which support a number of poles in multiple planes.

It is a further object of the invention to provide a coupler including means for accommodating a range of splay angles between the poles and for maintaining an established splay angle between the attached support poles.

It is a further object of the invention to provide a coupler having multiple sleeve bodies which interconnect to one another and are restrained to each other with one of the contained support poles.

It is a further object of the invention to provide a coupler wherein a support pole serves as the hinge pin of the coupler.

It is a further object of the invention to provide a two-piece coupler having multiple bores which receive tubular support poles and wing arms that extend from the sleeve bodies to overlap and fasten to each other to maintain a preferred angular orientation between the poles.

It is a further object of the invention to provide a coupler having overlapping wing arms which can contain slots, pre-set holes or which are adaptable to custom drilling.

Various of the foregoing objects, advantages and distinctions of the invention are obtained in a tent support system which includes a number of tubular poles which radiate from a number of adjustable couplers. The system provides an internal support skeleton for an overlying fabric cover. The poles can be cut to size or can telescope from each other. The poles are arranged to provide vertical and longitudinal support for the fabric cover. The system is particularly adaptable to cabin style tents.

Each coupler includes a number of tubular sleeve bodies and from each of which extend a pair of hinge arms and a wing arm. The hinge arms of a pair of adjoining sleeve bodies interlock with each other and are hinged together with an adjoining support pole that forms a hinge pin.

The wing arms project from the sleeve bodies, overlap and align in a defined registration to each other. The arms fasten to each other to maintain a desired splay angle. The splay angle can be determined by a fastener that mounts through aligned holes formed through the arms. Alternatively, a fastener can be fitted to aligned slots at the arms. A spring pin fitted to one arm may also mount to a socket in another arm. Set screws may also mount through the hinge arms to determine the splay angle.

Still other objects, advantages and distinctions of the invention are described at the following description with respect to the appended drawings. Various considered modifications and improvements are described as appropriate. The description should not be literally construed in limitation of the invention. Rather, the invention should be interpreted within the scope of the further appended claims.

DESCRIPTION OF THE PREFERRED EMBODIMENT

Figure 1:
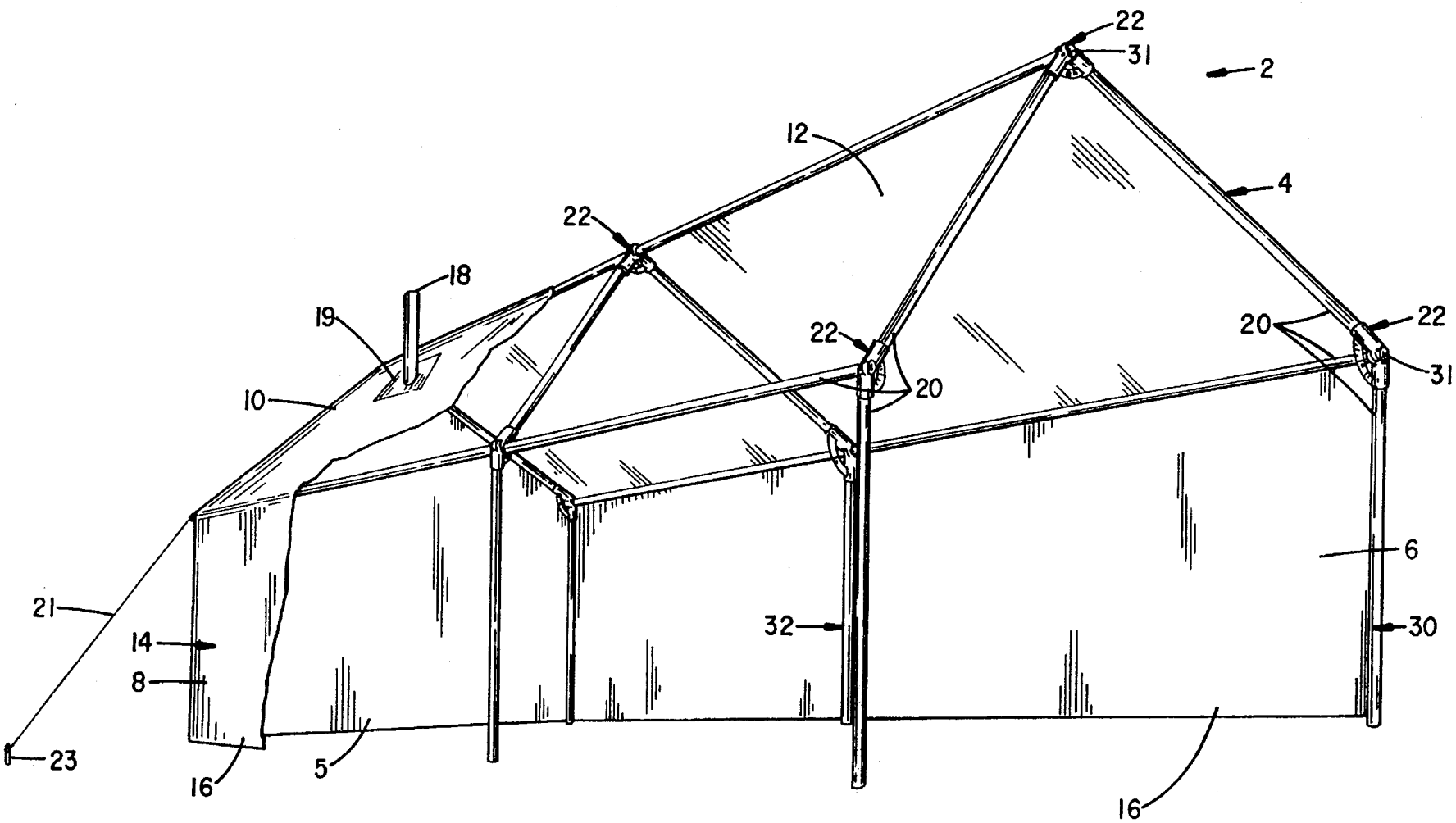
FIG. 1 is a perspective drawing to a walled cabin tent including a support frame having a number of adjustable support couplers.

Referring to FIG. 1, a perspective view is shown to a self-supported cabin tent 2. The tent 2 includes a support frame 4 that is configured to provide a pair of end walls 5 (only one of which is shown), side walls 6 and 8, and ceiling walls 10 and 12 at a fabric cover 14.

The cover 14 is constructed of a suitable grade canvas to resist wind, rain and snow. Depending upon the tent size, a number of fabric panels 16 are sewn together to provide a cover 14 of appropriate size. A chimney 18 is mounted through a fireproof panel 19. Door access flaps (not shown) are provided at one or both end walls 5. External tie down straps 21 and ground stakes 23 are provided as required to stabilize the tent 2. Windows and cover flaps (not shown) may also be provided. Although a cabin tent construction is shown, it is to be appreciated a variety of other shapes and sizes of covers 14 can be fitted to a frame 14 erected to a complementary shape. The organization and features of each cover 14 can be varied to particular user needs.

The frame 4 is constructed of a number of tubular poles 20 which are fitted to a number of adjustable support couplers 22. The number of poles 20 supported at each coupler 22 depends upon the location of the coupler 22 at the frame 14. Presently, the couplers 22 and poles 20 are sized to support lengths of 1 to 1⅜ inch round tubular steel conduit, commonly used as electrical conduit. Each coupler 22 supports three poles 20 that extend in two orthogonal planes. A variety of other solid and hollow tube stock materials of different dimensions and cross sectional shapes may also be used at the poles 20 to equal advantage.

Figure 2:
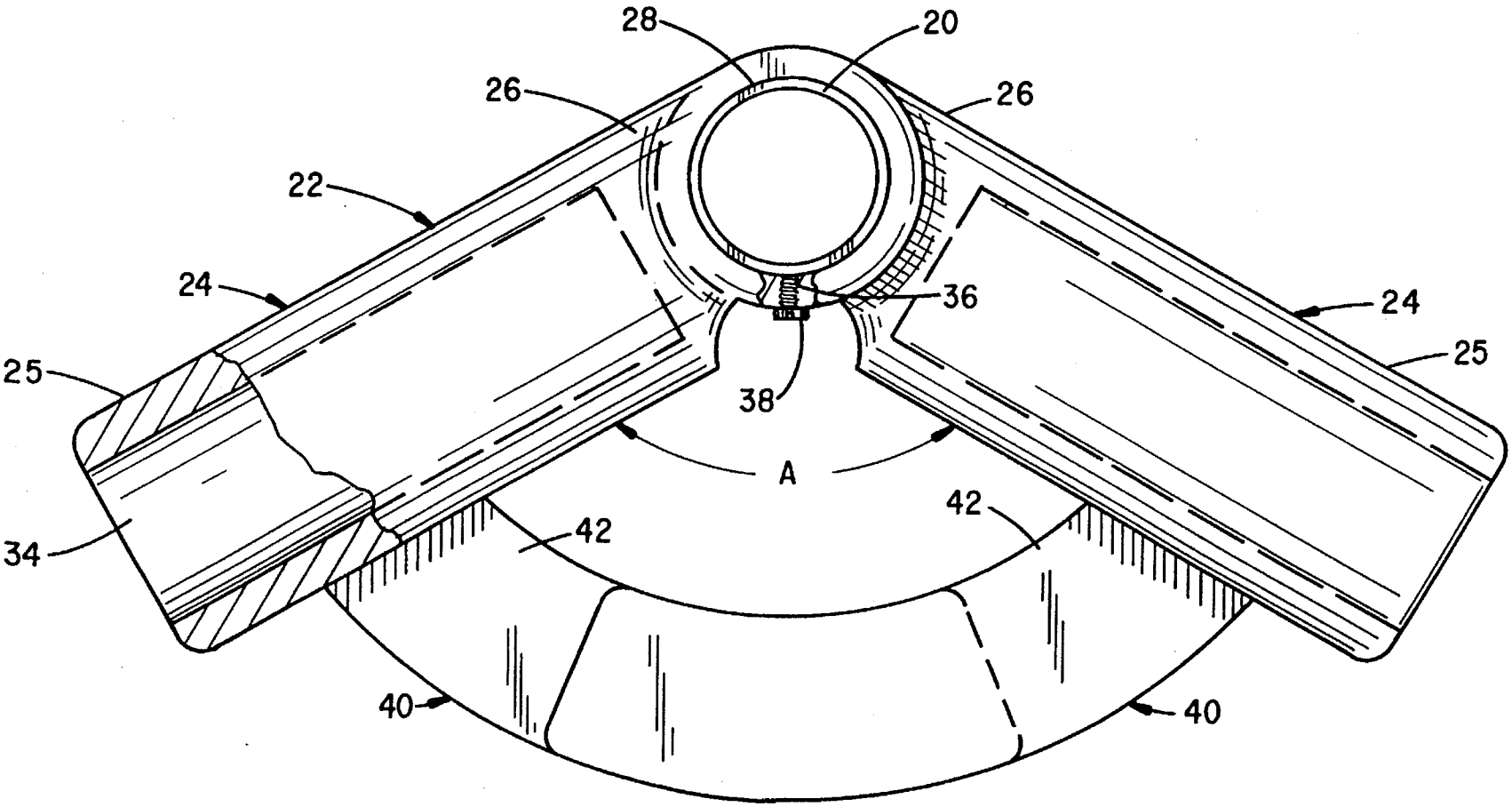
FIG. 2 is a front elevation view of a custom fit coupler.
Figure 3:
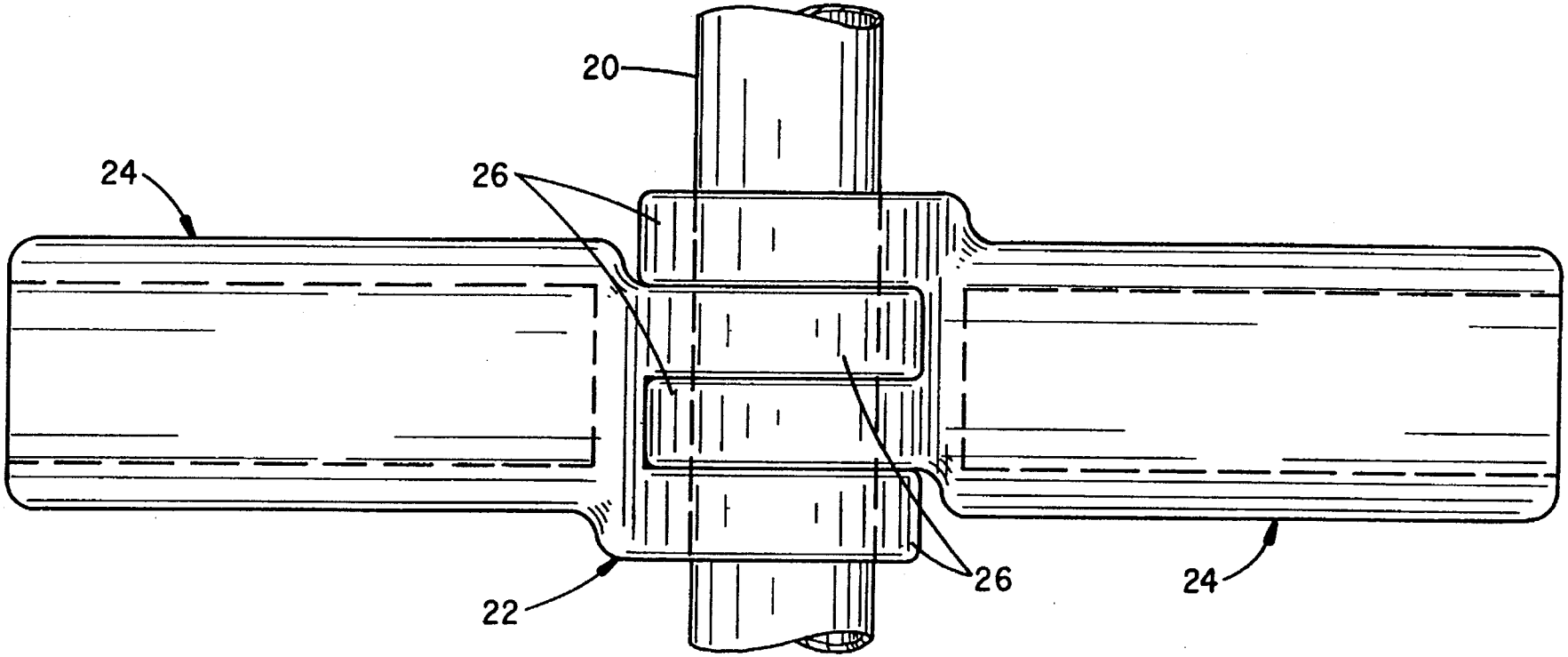
FIG. 3 is a top plan view of the interconnected portions of the coupler hinged to each other with a support pole.

With additional attention to FIGS. 2 and 3, each coupler 22 is constructed of a pair of identical sleeves 24, which mate at a pair of laterally displaced hinge arms 26 that extend from one end of a body 25. The sleeves 24 are constructed of die cast aluminum, but can be formed from a variety of other materials, such as fiber impregnated plastic, provided the material is able to withstand the loading and environmental conditions. The sleeves 24 may also be constructed as weldments.

The hinge arms 26 of each sleeve 24 are constructed to interlock with one another and align a through bore 28 of each arm 26 to the others. The bores 28 are sized to receive one or more poles 20. At FIG. 3, a pair of poles 20, which butt to one another at the center of the coupler 22, act as a hinge pin for the coupler 22, and which allows the sleeves 24 to rotate relative to each other.

A separate longitudinal bore 34 is provided in the body 25 of each sleeve 24. The bore 34 is sized to receive an end of one of the poles 20. Each coupler 22 is thereby able to support three poles 20 and the cover 14 in multiple planes.

A single pole 20 may terminate at the bore 28, as in the case of an end frame section 30. In this instance, an end cap 31 having a flanged end of a larger diameter than the bore 28 can be fitted to the tube 20 to prevent chaffing between the cover 14 and frame 4. The large diameter end flange also retains the pole 20 to the coupler 22. A pair of poles 20 may join at the coupler 22 or a single pole may pass through the coupler 22, as in the case of an intermediate frame section 32.

A smaller bore 36 may be provided at at least one of the hinge arms 26 of each sleeve 24. A set screw 38 can be fitted to each bore 36 to lock the poles 20 to the coupler 22. Preferably the bore 36 is located at the underside of the hinge arm 26 to prevent abrasive contact between the set screw 38 and fabric, once the splay angle is set at a pair of further included wing arms 40.

Projecting from each body 25, beneath the hinge arms 26 is a wing arm 40. The wing arms 40 of the hinged sleeves 24 overlap one another over a range of rotation of the sleeves 24. Upon securing the wing arms 40 to each other, a splay angle "A" is established at the sleeves 24 and coupled poles 20. The wing arms 40 of the presently preferred couplers 22 arcuately extend from the sleeves 24 and overlap over a range of rotation on the order of 0 to 60 degrees. Wing arms of differing shapes can be constructed which overlap over greater or lesser, defined ranges.

The wing arms 40 can be secured to each other in a variety of fashions with a variety of fasteners, reference FIGS. 2 and 4 through 7. The wing arms 40 at FIG. 2 provide blank surfaces 42 which arms can be drilled at desired overlapping locations and fitted with appropriate through fasteners, such as a bolt 44, lock washer 46 and mating nut. The coupler 22 can thus be custom fitted to a preferred location within the overall support system of the framework 4.

Figure 4:
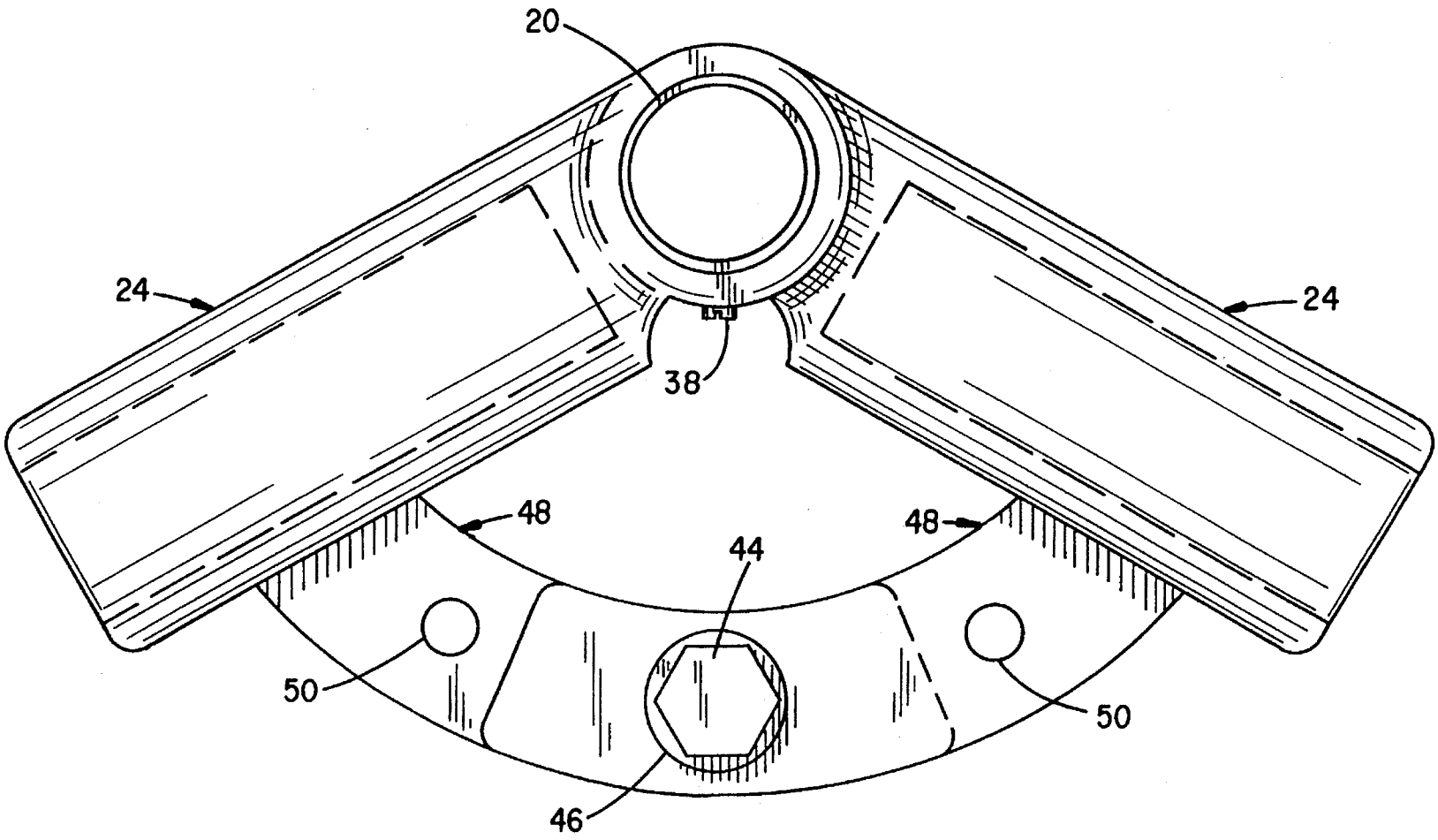
FIG. 4 is an elevation view to a coupler wherein the overlapping wing arms are retained with a bolt fastener.

FIGS. 4 through 7 depict alternative wing arm fastener arrangements. FIG. 4 depicts wing arms 48 which include a number of preformed through apertures 50. Upon aligning one or more sets of apertures 50, the fastener 44 can be inserted to maintain an established splay angle. In a preferred construction of this type, a pair of holes 50 at each wing arm 48 are arranged to provide splay angles of 30 and 35 degrees.

Figure 5:
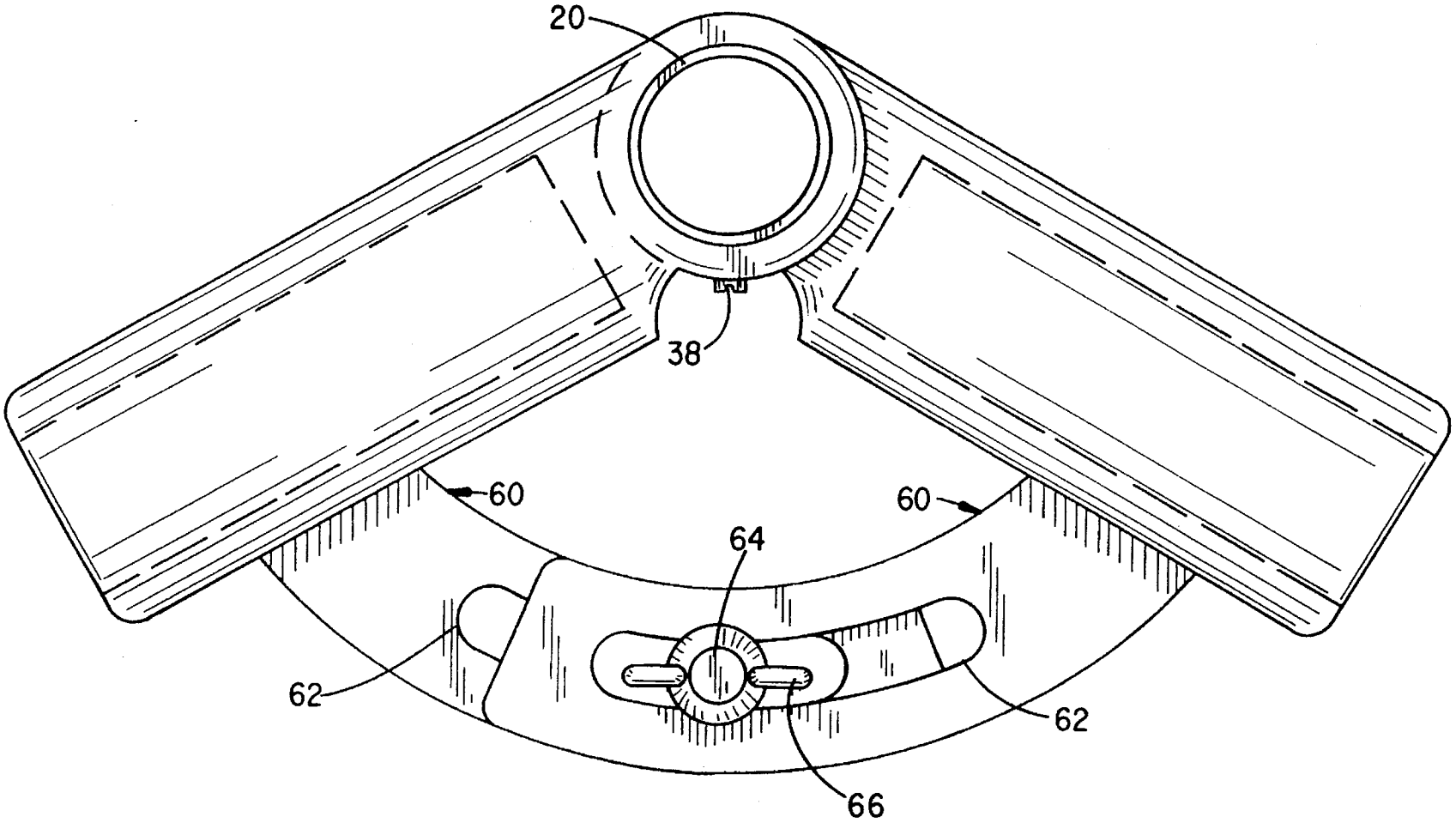
FIG. 5 is an elevation view to a coupler wherein the wing arms include overlapping slots.

FIG. 5 depicts a pair of wing arms 60 having overlapping slots 62. A threaded fastener 64 and wing nut 66 cooperate with the arms 60 to fix the splay angle "A" over the range of slots 62.

Figure 6:
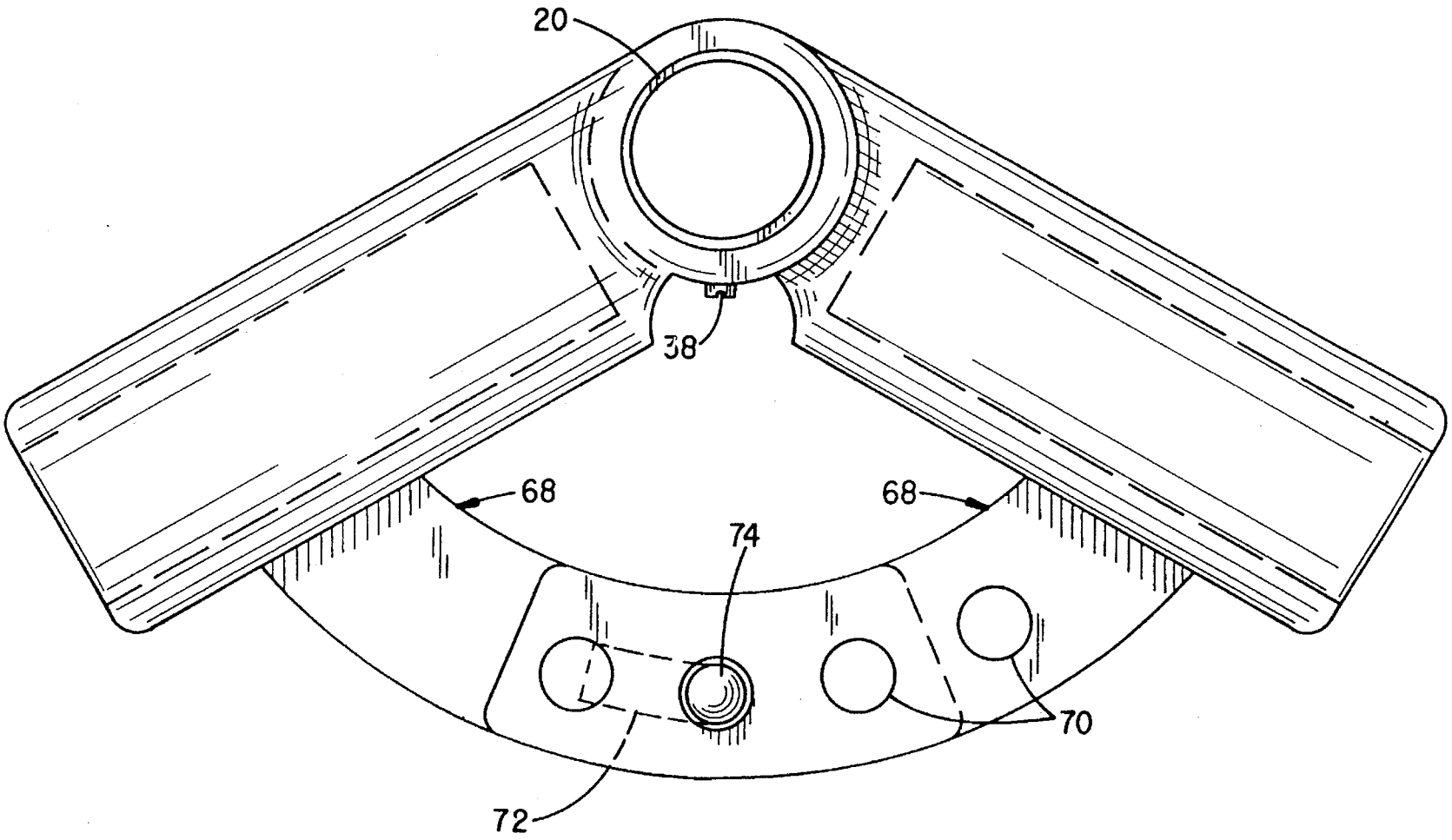
FIG. 6 is an elevation view to a coupler having spring pin fastened wing arms.

FIG. 6 depicts a pair of wing arms 68 having alignable apertures 70 which are retained with a flat spring 72. The spring 72 can be riveted or spot welded to the wing arm 68 and from which a pin 74 projects and fits through aligned apertures 70.

Figure 7:
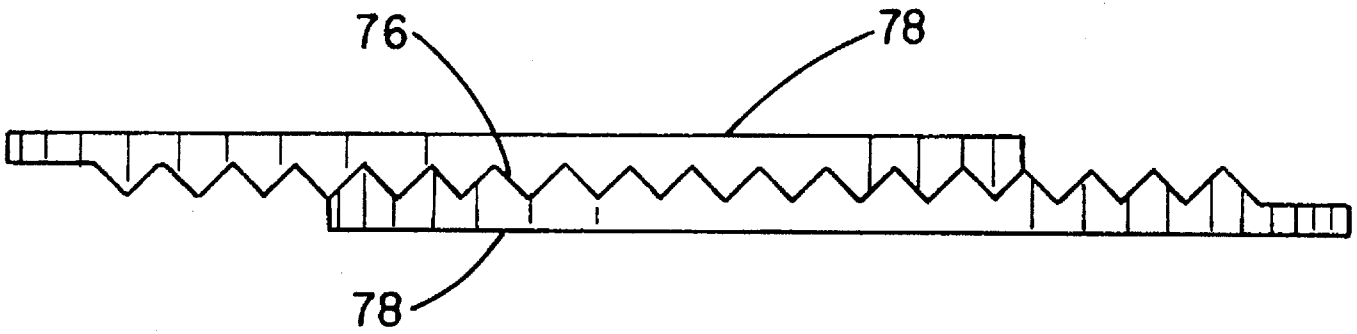
FIG. 7 is a partial plan view of the wing arms of a coupler wherein the wing arms have a serrated locking surface.

FIG. 7 depicts portions of a pair of a wing arms 76 having serrated surfaces 78. The serrations overlap and interlock to fix the splay angle. A through fastener may or may not be required to retain the arms 76 together.

In the latter instance, the arms 76 can be constructed to exhibit a resilience, such as by bowing the surfaces 78 in directions which assure firm contact between the serrations, when flexed in an opposite direction, as they are fitted to each other. Still other fastener arrangements can be provided at the wing arms for fixing a preferred splay angle.

Figure 8:
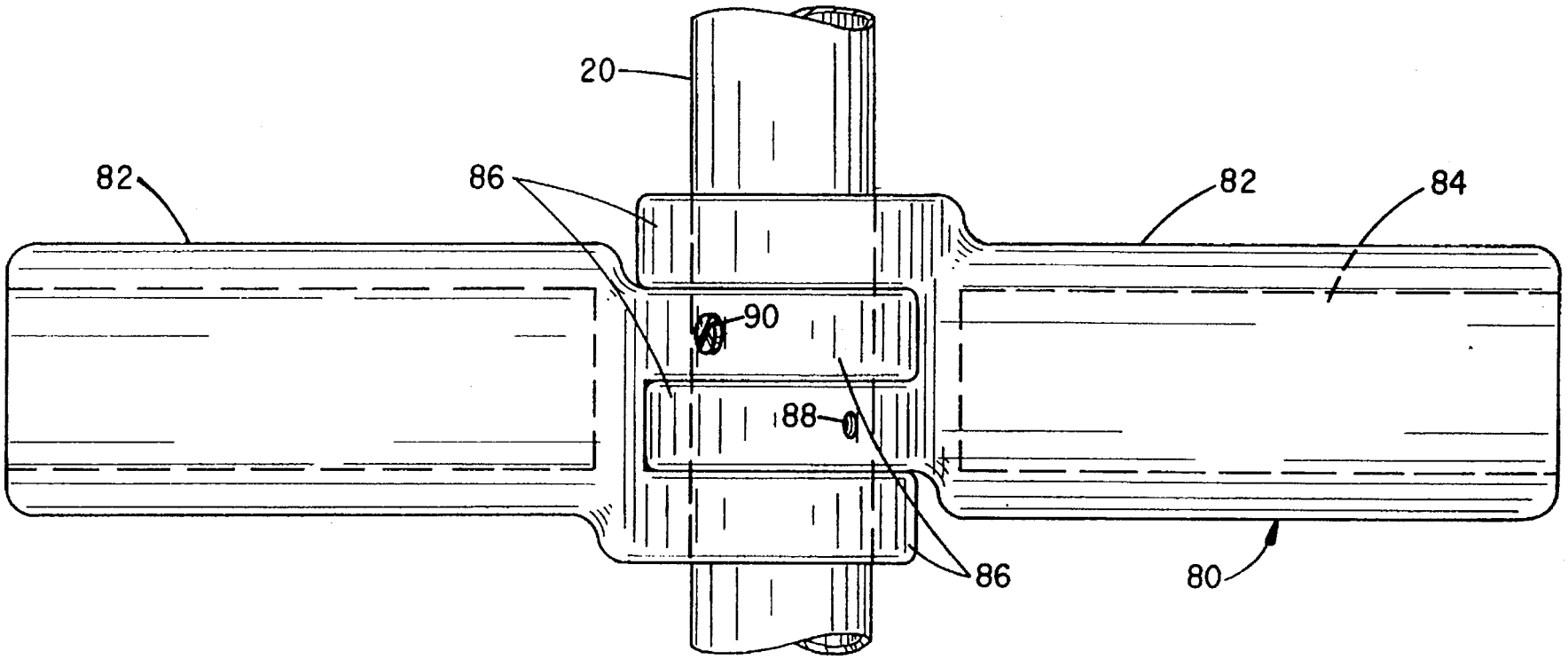
FIG. 8 is a bottom plan view of a coupler without wing arms and wherein the hinge arms are retained with set screws to the pole.

FIG. 8 lastly depicts a coupler 80 which is substantially identical to the coupler 22. The coupler 80 includes a pair of sleeves 82 which have longitudinal bores 84. The coupler 80 does not include wing arms. Hinge arms 86 project from an opposite end of the sleeves 82 and at least two of which include apertures 88. The coupler 80 is retained to a pole 20 at a preferred splay angle with a pair of set screws 90 that are fitted to the apertures 88. With each assembly of a tent 2, it is thus necessary to re-establish the splay angle at each coupler 80 relative to the poles 20, although in some circumstances this may not present an inconvenience.

While the invention has been described with respect to a preferred construction and considered modifications and improvements thereto, still other constructions might be suggested to those skilled in the art. The invention should therefore be broadly construed within the spirit and scope of the further appended claims.

What is claimed is:

1. A tent support assembly, comprising:

a) a plurality of poles;

b) a plurality of couplers securing a plurality of said poles to one another to project in multiple planes, wherein each of said couplers comprises first and second sleeves, wherein each sleeve has a body including a longitudinal bore, wherein a hinge arm and a wing arm project from the body, wherein each hinge arm includes a bore that projects transverse to the longitudinal bore, wherein the transverse bores of the hinge arms coaxially align with one another and receive at least one of said poles, wherein the wing arms overlap one another over a range of rotation of said first and second sleeves about the one of said poles, and including fastener means for retaining said first and second wing arms to one another at a selected splay angle; and c) wherein said plurality of poles and couplers are mounted to one another to form a self-supported framework and to which framework a fabric tent cover is secured.

2. The tent support assembly as set forth in claim 1 wherein said hinge and wing arms are integrally cast with the body of said first and second sleeves, and wherein said first and second sleeves are symmetrically identical.

3. The tent support assembly as set forth in claim 2 including first and second displaced hinge arms, and wherein the hinge arms of the first and second sleeves interlock with one another.

4. The tent support assembly as set forth in claim 3 wherein at least one of hinge arms of said first and second sleeves includes an aperture that communicates with the pole receiving bore and receives a fastener to retain the one of said poles to the interlocked first and second sleeves.

5. The tent support assembly as set forth in claim 3 wherein the wing arms of said first and second sleeves exhibit an arcuate curvature and overlap over a range of rotation to determine a splay angle between said first and second sleeves on the order of 10 to 180 degrees.

6. The tent support assembly as set forth in claim 1 wherein the wing arms of said first and second sleeves include a plurality of through apertures which selectively align and further including a threaded fastener which mounts through aligned apertures to retain said wing arms to one another to determine a preferred splay angle between said first and second sleeves.

7. The tent support assembly as set forth in claim 1 wherein the wing arms of said first and second sleeves each include a slot, which slots align over a range of rotation of said first and second sleeves, and a threaded fastener which extends through the aligned slots for retaining said wing arms to one another to determine a preferred splay angle between said first and second sleeves.

8. The tent sport assembly as set forth in claim 1 wherein the wing arms of said first and second sleeves each include a plurality of through apertures which selectively align, wherein a pin is retained to one of said arms, and means for spring biasing said pin to engage aligned apertures for retaining said wing arms to one another to determine a preferred splay angle between said first and second sleeves.

9. The tent support assembly as set forth in claim 1 wherein said wing arms each include adjoining serrated surfaces, wherein the serrations project and interlock with one another over the range of rotation to retain for retaining said wing arms to one another to determine a preferred splay angle between said first and second sleeves.

10. A coupler for retaining a plurality of poles to one another comprising first and second sleeves, wherein each sleeve has a body including a longitudinal bore sized to receive a pole, wherein first and second laterally displaced hinge arms project from said body, wherein each hinge arm includes a bore that projects transverse to the longitudinal bore, wherein the transverse bores of the first and second hinge arms coaxially align with one another to receive a pole, wherein a wing arm projects from the body of each of said first and second sleeves, wherein the wing arms overlap one another over a range of rotation of said first and second sleeves about the one of said poles, and including fastener means for retaining said wing arms to one another to determine a preferred splay angle between said first and second sleeves.

11. The coupler as set forth in wherein at least one of the first and second hinge arms of each of said first and second sleeves includes an aperture that communicates with the transverse bore and which receives a fastener to retain the one of said poles to the interlocked first and second sleeves at a selected alignment.

12. A coupler for retaining a plurality of poles to one another comprising first and second sleeves, wherein each sleeve has a body including a longitudinal bore sized to receive a pole, wherein first and second laterally displaced hinge arms project from the body, wherein each hinge arm includes a bore that projects transverse to the longitudinal bore, wherein the transverse bores of the hinge arms coaxially align to one another to receive a pole, wherein at least one of said first and second hinge arms includes an aperture that communicates with the transverse bore and which aperture receives a fastener to retain the one of said poles to the interlocked first and second sleeves.

13. The coupler as set forth in claim 10 wherein the fastener means comprises a plurality of through apertures at said wing arms which selectively align and further including a threaded fastener which mounts through the aligned apertures to determine the splay angle.

14. The coupler as set forth in claim 10 wherein the fastener means comprises slots at said wing arms which align and a threaded fastener which extends through the aligned slots to determine the splay angle.

15. The coupler as set forth in claim 10 wherein the fastener means comprises a plurality of apertures at said wing arms which selectively align, wherein a pin is retained to one of said wing arms, and means for spring biasing said pin to engage aligned apertures to determine the splay angle.

16. The coupler as set forth in claim 10 wherein the fastener means comprises adjoining serrated surfaces at said wings arms which surfaces interlock with one another over a range of rotation to determine the splay angle.

17. A coupler for retaining a plurality of poles to one another comprising first and second sleeves, wherein each sleeve has a body including a longitudinal bore sized to receive a pole, wherein at least one hinge arm projects from the body, wherein the hinge arm includes a bore that projects transverse to the longitudinal bore, wherein the transverse bores of the hinge arm of said first and second sleeves coaxially align to one another to receive a pole and means for determining a splay angle between said first and second sleeves, whereby the sleeves are hinged to one another.

18. The coupler as set forth in claim 17 wherein at least the hinge arm of each sleeve includes an aperture that communicates with the transverse bore and which aperture receives a fastener to retain the pole to the first and second sleeves.

* * * * *